US008511346B2

(12) United States Patent
Scheidig et al.

(10) Patent No.: US 8,511,346 B2
(45) Date of Patent: Aug. 20, 2013

(54) CONTROL VALVE FOR A CAMSHAFT ADJUSTER

(75) Inventors: Gerhard Scheidig, Oberasbach (DE); Ali Bayrakdar, Roethenbach/Pegnitz (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 364 days.

(21) Appl. No.: 12/864,268

(22) PCT Filed: Jan. 24, 2009

(86) PCT No.: PCT/EP2009/000458

§ 371 (c)(1),
(2), (4) Date: Jul. 23, 2010

(87) PCT Pub. No.: WO2009/092610

PCT Pub. Date: Jul. 30, 2009

(65) Prior Publication Data

US 2010/0294387 A1 Nov. 25, 2010

(30) Foreign Application Priority Data

Jan. 26, 2008 (DE) ..... 10 2008 006 179

(51) Int. Cl.
*F16K 11/07* (2006.01)

(52) U.S. Cl.
USPC ..... 137/625.66; 123/90.17

(58) Field of Classification Search
USPC ..... 137/596.12, 625.2, 625.66, 625.25, 137/596.18; 123/90.17, 90.18, 90.27, 90.31
See application file for complete search history.

(56) References Cited

U.S. PATENT DOCUMENTS

| | | | | |
|---|---|---|---|---|
| 4,729,543 | A * | 3/1988 | Aricha | 251/121 |
| 5,443,083 | A * | 8/1995 | Gotthelf | 137/484.8 |
| 6,029,703 | A | 2/2000 | Erickson et al. | |
| 6,065,495 | A * | 5/2000 | Fong et al. | 137/625.25 |
| 6,848,404 | B2 * | 2/2005 | Maeyama et al. | 123/90.17 |
| 2002/0026914 | A1 | 3/2002 | Maeyama et al. | |
| 2003/0226593 | A1 | 12/2003 | Okada et al. | |
| 2004/0182450 | A1 | 9/2004 | Maeda et al. | |
| 2005/0011703 | A1 * | 1/2005 | Yamaguchi | 184/6.9 |
| 2006/0016495 | A1 | 1/2006 | Strauss et al. | |
| 2006/0021933 | A1 * | 2/2006 | Radcliffe | 210/483 |
| 2007/0095315 | A1 * | 5/2007 | Hoppe et al. | 123/90.17 |

FOREIGN PATENT DOCUMENTS

| | | |
|---|---|---|
| DE | 102005052481 | 5/2007 |
| EP | 1752691 A | 2/2007 |
| WO | 2007/051704 A | 5/2007 |

* cited by examiner

*Primary Examiner* — John K Fristoe, Jr.
*Assistant Examiner* — Reinaldo Sanchez-Medina
(74) *Attorney, Agent, or Firm* — Lucas & Mercanti, LLP

(57) ABSTRACT

A control valve for a device for variably setting control times of gas exchange valves of an internal combustion engine. The control valve has a valve housing, which is hollow, and at least one inflow connection, at least one exhaust connection, and at least two working connections; a hydraulic medium conduction insert disposed in the valve housing and implemented as hollow, having hydraulic medium conduction channels, which are disposed in the wall of the hydraulic medium conduction insert and communicate with the working connections; and a control piston, which is disposed in the hydraulic medium conduction insert. The hydraulic medium conduction insert has a guide sleeve, in which the control piston is guided. The guide sleeve has a plastic encapsulation, in which at least two of the hydraulic medium conduction channels are disposed, and a filter fabric is provided between the plastic encapsulation and the guide sleeve.

11 Claims, 3 Drawing Sheets

CONTROL VALVE FOR A CAMSHAFT ADJUSTER

Figure 1:
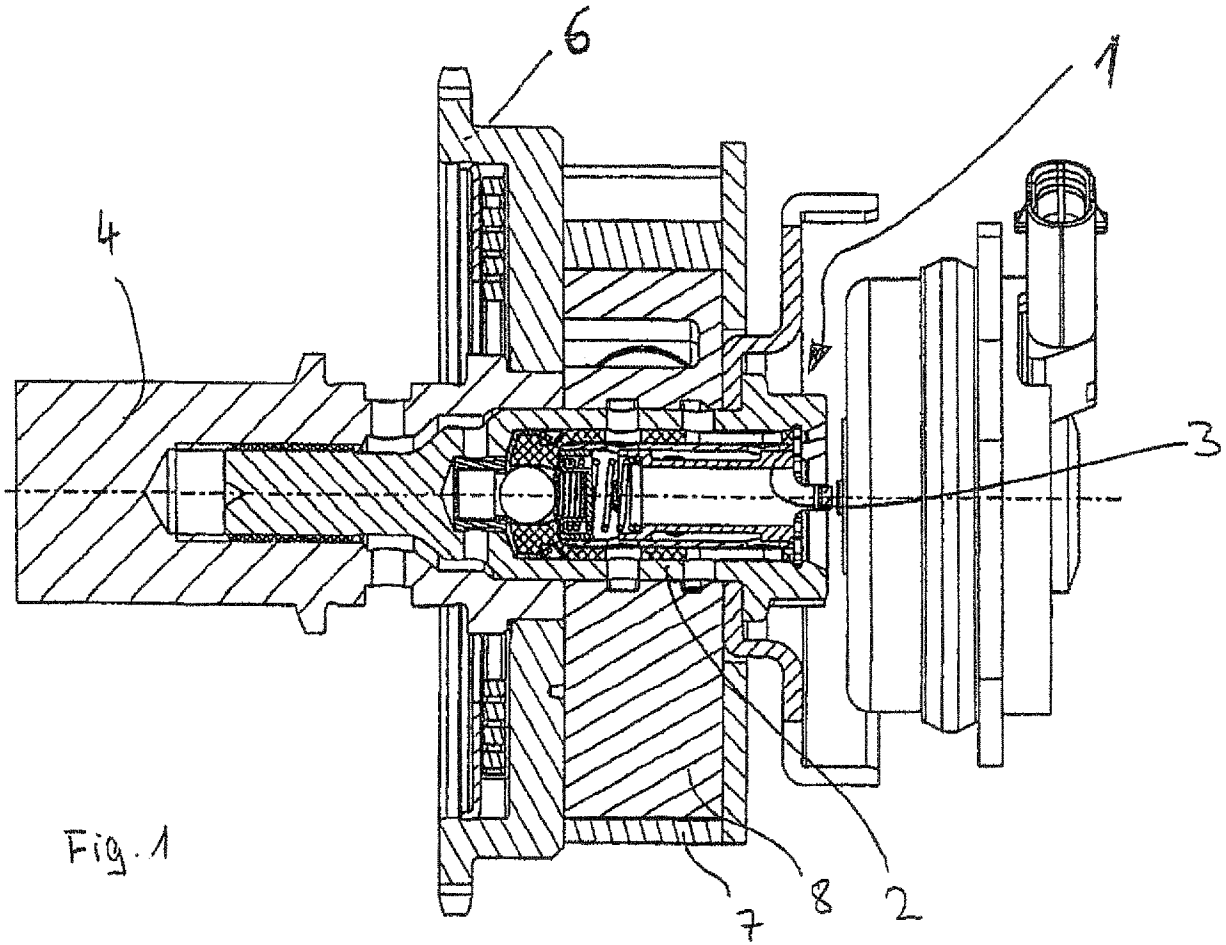

This application is a 371 of PCT/EP2009/000458 filed Jan. 24, 2009, which in turn claims the priority of DE 10 2008 006 179.4 filed Jan. 26, 2008, the priority of both applications is hereby claimed and both applications are incorporated by reference herein.

FIELD OF THE INVENTION

The invention relates to a control valve for a device for variable setting of the control times of gas exchange valves in internal combustion engines according to the preamble of claim 1.

A control valve of the generic type is known, for example, from DE 10 2005 052 481 A1. Filtering of the hydraulic fluid here proceeds by means of a separate filter associated with the inlet channel and/or by using an oil separation sleeve. A disadvantage of these solutions is that the separate oil separation sleeve creates an increased risk of chips arising during fitting of the oil separation sleeve, wherein the chips may clog the hydraulic fluid conduction channels or impair movement of the parts relative to one another in such a way that the valve can no longer fulfill its function. In addition, it is costly to use separate filters during manufacture and fitting.

The object of the invention is to provide a control valve with improved functional reliability which is inexpensive to produce and to fit.

The object is achieved according to the invention by a control valve having the features of claim 1, advantageous configurations and further developments being indicated in the subclaims.

It is proposed according to the invention for the hydraulic fluid conduction insert to comprise a guide sleeve, in which the control piston is guided, for the guide sleeve to comprise a plastics injection-molded encapsulation, in which at least two of the hydraulic fluid conduction channels are arranged, and for a filter fabric to be provided between the plastics injection-molded encapsulation and the guide sleeve.

The basic concept of the invention is that, with the guide sleeve and the injection-molded encapsulation, the hydraulic fluid conduction insert has a two-part structure, a filter fabric being provided between the two parts. The filter needed for the hydraulic fluid is thus already incorporated into the hydraulic fluid conduction insert, such that the risk of chips and the manufacturing and fitting costs arising due to the separate part needed hitherto are not applicable. In addition, the invention offers the advantage of the filter being arranged as close as possible to the control edges of the hydraulic fluid conduction insert, such that these are protected in the best possible way from dirt particles.

It is additionally proposed that the filter element is associated with at least two hydraulic fluid conduction channels, it being further proposed that the filter fabric is associated with at least one inflow and one outflow channel. In this way, the hydraulic fluid can be filtered with little expenditure in the hydraulic fluid conduction channels with just a single filter fabric. In this way, a filter area is provided which is considerably enlarged in comparison with the prior art, so providing better cleaning of the hydraulic fluid.

After the encapsulation by injection molding, the filter fabric may in sections be surrounded on both sides by the injection-molded encapsulation, reinforcing the connection of the two parts in this way.

The filter fabric may furthermore be of tubular configuration, such that it is automatically associated with all the circumferential openings of the hydraulic fluid conduction channels after being attached to the guide sleeve and encapsulated by injection molding. The largest possible filter area is thus provided, and all the control edges are protected with just one filter fabric.

The structure of the control valve may be further simplified in that the injection-molded encapsulation comprises a guide for a nonreturn valve at its end facing the camshaft. In this way the insert previously needed in the control valve is dispensed with and the number of control valve parts is reduced further.

The guide sleeve may take the form of a steel part, and serves on the one hand as a guide element for the control piston arranged therein and on the other hand as a dimensionally stable part in the two-part hydraulic fluid conduction insert encapsulated by injection molding.

The filter fabric may be resiliently expandable, such that it may, with expansion, be drawn onto the guide sleeve. In addition, the filter fabric may in this way give under possible strain from the changing hydraulic fluid flows, without the risk of sudden unforeseen tearing.

The filter fabric may be made from an inexpensive plastics material, such that it may fuse with the plastics injection-molded encapsulation.

Alternatively, a steel fabric of stainless steel may also be used, this being advantageous with regard to the temperature of the hydraulic fluid and to any continuous stresses which arise.

It is further proposed that the fabric comprise rhombus-shaped openings. In this way, the expandability of the fabric is independent of the material properties thereof.

Figure 2:
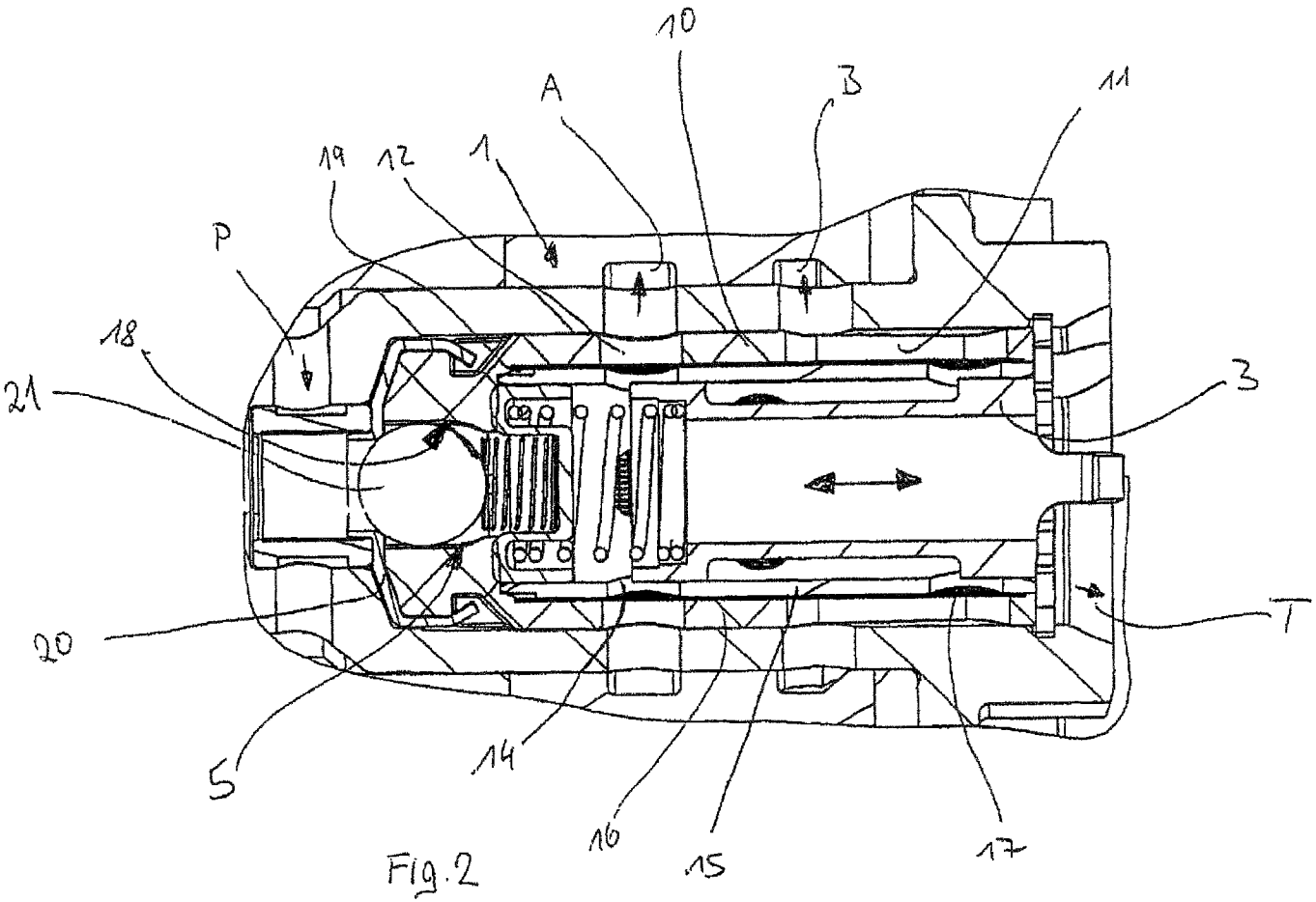
Figure 3:
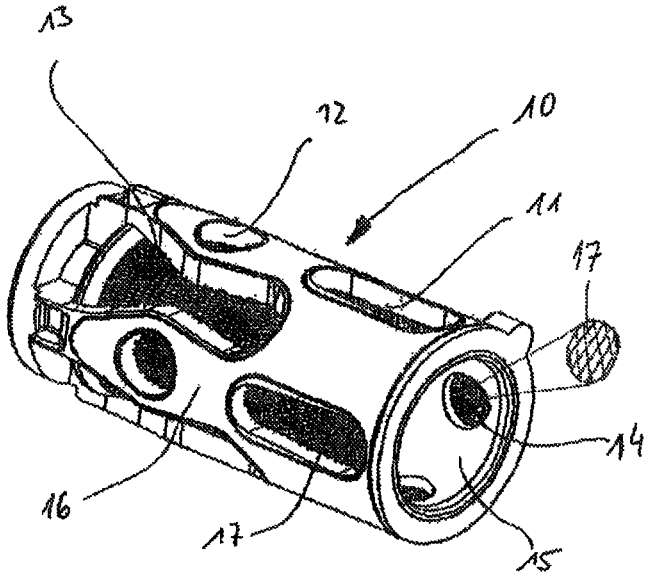

The invention is described in greater detail below with reference to a preferred exemplary embodiment. The drawings show specifically:

FIG. 1: a device for variable setting of the control times of gas exchange valves of an internal combustion engine with a control valve according to the invention;

FIG. 2: a control valve with hydraulic fluid insert with integral filter; and FIG. 3: a hydraulic fluid insert with integral fabric.

FIG. 1 shows a device for variable setting of the control times of gas exchange valves of an internal combustion engine, which comprises a drive wheel 6 which is connected rotatably fixedly with a stator 7. A rotor 8 is additionally provided, which is connected rotatably fixedly with a camshaft 4. The drive wheel 6 is driven directly or indirectly by the crankshaft of the internal combustion engine. The rotary motion of the drive wheel 6 is then transmitted via the stator 7 to the rotor 8, such that the camshaft 4 connected rotatably fixedly with the rotor 8 is likewise set in rotation. The rotating camshaft 4 then controls the opening and closing times of the gas exchange valves of the internal combustion engine. The control times of the gas exchange valves are then adjusted by relative rotation of the rotor 8 relative to the stator 7, which is controlled by the control valve 1.

FIG. 2 and FIG. 3 show the control valve 1 and the hydraulic fluid conduction insert 10 thereof. The control valve 1 comprises a hydraulic fluid inlet "P" on the camshaft side and a hydraulic fluid outlet "T" arranged at the end remote from the camshaft 4. Two working ports "A" and "B" are also provided, which communicate with the pressure chambers between the rotor 8 and the stator 7. In the control valve 1 a hydraulic fluid conduction insert 10 is arranged, which comprises hydraulic fluid conduction channels 11, 12, 13, 14, which are or may be connected flow-wise with the inlet port "P", the outlet port "T" and the working ports "A" and "B". A control piston 3 is guided displaceably in the hydraulic fluid conduction insert 10. Depending on the position of the control piston 3, a connection is then produced between the hydraulic fluid inlet "P" and the working ports "A" and "B", or the hydraulic fluid outlet "T". There is no need to examine the control here in any greater detail, since it is part of the prior art and is described sufficiently well for example in DE 10 2005 052 481 A1. Reference is thus explicitly made to the disclosure of DE 10 2005 052 481 A1 to assist in understanding the invention.

The hydraulic fluid conduction insert 10 has a two-part structure with a guide sleeve 15 and an injection-molded encapsulation 16. The guide sleeve 15 is provided with openings 14, which can be closed by means of a control piston 3 guided on the inside of the guide sleeve 15. The injection-molded encapsulation 16 is provided on the outside with the hydraulic fluid conduction channels 11, 12 and 13. All the hydraulic fluid conduction channels 11, 12, 13 and the openings 14 are provided with a filter fabric 17, which is incorporated into the hydraulic fluid conduction insert 10. The filter fabric 17 is arranged on the guide sleeve 15 prior to encapsulation by injection molding, such that it is itself a constituent of the hydraulic fluid conduction insert 10 after encapsulation by injection molding. The filter fabric 17 is of tubular configuration and thus, after being pulled over the guide sleeve 15 and after encapsulation by injection molding, automatically covers all the hydraulic fluid conduction channels 11, 12, 13 arranged circumferentially in the hydraulic fluid conduction insert 10 and the openings 14, this being irrespective of the number, geometry and arrangement thereof. The filter fabric 17 is enclosed on both sides at its end 19 facing the camshaft 4 by injection-molded encapsulation, such that a particularly strong physical connection is here produced between injection-molded encapsulation 16 and filter fabric 17. As shown is the enlarged section of the filter fabric in FIG. 3, the filter fabric 17 has rhombus-shaped opening.

In addition, on the hydraulic fluid conduction insert 10, on the side thereof facing the camshaft 4, there is provided a guide 18 for the closing member 21 of a nonreturn valve 5 in the feed channel "P". The guide 18 is formed by an externally accessible orifice, into which the closing member 21 can be introduced. After introduction of the closing member 21, a sealing part 20 is connected from the outside with the injection-molded encapsulation 16. The closing member 21 rests under spring loading against the sealing part 20 when the nonreturn valve 5 is closed. For the action and manner in which the spring loading is produced, reference is made to DE 10 2005 052 481 A1. In this way, the number of individual parts of the control valve 1 is again reduced, wherein the additional advantage is provided that the nonreturn valve 5 can be manufactured and fitted as a preassembled assembly with the hydraulic fluid conduction insert 10. The guide 18 tapers at its end comprising the spring passage, such that the closing member 21 is accommodated captively in the guide 18 after introduction into the guide 18 and attachment of the sealing part 20.

The invention claimed is:

1. A control valve for a device for variable setting of control times of gas exchange valves of an internal combustion engine, comprising: a valve housing of hollow construction having at least one inlet port, at least one outlet port and at least two working ports; and a hydraulic fluid conduction insert of hollow construction arranged in the valve housing, with hydraulic fluid conduction channels arranged in a wall of the hydraulic conduction insert and communicating with the working ports, and a control piston arranged in the hydraulic fluid conduction insert, wherein the hydraulic fluid conduction insert comprises a guide sleeve, in which the control piston is guided, the guide sleeve comprising a plastics injection-molded encapsulation, in which as least two of the hydraulic fluid conduction channels are arranged, and a filter fabric is provided between the plastics injection-molded encapsulation and the guide sleeve, where the filter fabric is a complete cylinder and is arranged at least partially over the guide sleeve.

2. The control valve of claim 1, wherein the filter fabric is associated with at least two of the hydraulic fluid conduction channels.

3. The control valve of claim 1, wherein the filter fabric is associated with at least one inflow and/or one outflow channel.

4. The control valve of claim 1, wherein at least one section of the filter fabric is surrounded on both sides by the plastics injection-molded encapsulation.

5. The control valve of claim 1, wherein the device for variable setting of control times of gas exchange valves is connected directly or indirectly to a camshaft of the internal combustion engine, and the plastics injection-molded encapsulation forms a guide for a nonreturn valve at an end facing the camshaft.

6. The control valve of claim 5, wherein the guide is formed of an orifice into which a closing member of the nonreturn valve can be introduced from an outside, and a sealing part is provided which can be connected in a noninterlocking manner with the injection-molded encapsulation, against which sealing part the closing member rests when the nonreturn valve is closed.

7. The control valve of claim 1, wherein the guide sleeve is a steel part.

8. The control valve of claim 1, wherein the filter fabric is resiliently expandable.

9. The control valve of claim 1, wherein the filter fabric is a plastics fabric.

10. The control valve of claim 1, wherein the filter fabric is a steel fabric of stainless steel.

11. The control valve of claim 1, wherein the filter fabric comprises rhombus-shaped openings.

* * * * *

UNITED STATES PATENT AND TRADEMARK OFFICE

CERTIFICATE OF CORRECTION

PATENT NO. : 8,511,346 B2
APPLICATION NO. : 12/864268
DATED : August 20, 2013
INVENTOR(S) : Scheidig et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 365 days.

Signed and Sealed this
Fifteenth Day of September, 2015

Michelle K. Lee

Michelle K. Lee
*Director of the United States Patent and Trademark Office*